US008672363B2

(12) United States Patent
Ishibashi

(10) Patent No.: US 8,672,363 B2
(45) Date of Patent: Mar. 18, 2014

(54) PRINTED MATTER FORMING METHOD

(71) Applicant: FUJIFILM Corporation, Tokyo (JP)

(72) Inventor: Hideyasu Ishibashi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/925,294

(22) Filed: Jun. 24, 2013

(65) Prior Publication Data

US 2013/0287932 A1 Oct. 31, 2013

Related U.S. Application Data

(62) Division of application No. 12/801,682, filed on Jun. 21, 2010.

(30) Foreign Application Priority Data

Jun. 22, 2009 (JP) ..... 2009-148113

(51) Int. Cl.
*B42D 15/00* (2006.01)

(52) U.S. Cl.
USPC ..... 283/91; 283/72

(58) Field of Classification Search
USPC ..... 283/91
See application file for complete search history.

(56) References Cited

U.S. PATENT DOCUMENTS

| | | | | |
|---|---|---|---|---|
| 3,523,503 | A * | 8/1970 | Rodi et al. | 101/32 |
| 4,932,685 | A | 6/1990 | Mancuso | |
| 6,113,149 | A | 9/2000 | Dukatz | |

FOREIGN PATENT DOCUMENTS

| | | | |
|---|---|---|---|
| EP | 1052116 | A2 | 11/2000 |
| JP | 04-299173 | A | 10/1992 |
| JP | 2004-122496 | A | 4/2004 |
| JP | 2010-179518 | A | 8/2010 |
| WO | 2006/063803 | A2 | 6/2006 |
| WO | 2008/069817 | A1 | 6/2008 |

OTHER PUBLICATIONS

Satoshi Kubota, "Bionomics of Liquid Displays", 1992, pp. 52-55.

* cited by examiner

*Primary Examiner* — Kyle Grabowski
(74) *Attorney, Agent, or Firm* — Jean C. Edwards, Esq.; Edwards Neils PLLC

(57) ABSTRACT

Provided is a printed matter, a printed matter forming apparatus, and a printed matter forming method, which improve the expression of the texture. A lower layer having an upper surface provided with concavities and convexities different for each region; an image layer provided above the lower layer, the image layer forming an image and transmitting part of incident light towards the lower layer; and a surface layer provided above the image layer, the surface layer having an upper surface provided with concavities and convexities different for each region, the surface layer transmitting part of incident light towards the image layer are included. This allows various textures to be expressed fully.

6 Claims, 6 Drawing Sheets

PRINTED MATTER FORMING METHOD

TECHNICAL FIELD

The present application is a divisional patent application of U.S. patent application Ser. No. 12/801,682 filed Jun. 21, 2010, which claims priority from Japanese Patent Application No. 2009-148113 filed on Jun. 22, 2009, the contents of all of which are hereby incorporated by reference in their entirety into this application.

BACKGROUND

Description of the Related Art

Conventionally, a technology of expressing gloss of a plurality of phases by controlling a state of a surface of a printed image by differing a method of applying a liquid composition is known (see Patent Document No. 1).

Patent Document No. 1: Japanese Patent Application Publication No. 2004-122496

SUMMARY

However, since the technology only changes the specular reflexibility on a surface of a printed image, the texture of the printed image cannot be fully expressed.

So as to solve the stated problems, according to a first aspect of the innovations herein, provided is a printed matter including: a lower layer having an upper surface provided with concavities and convexities different for each region; an image layer provided above the lower layer, the image layer forming an image and transmitting part of incident light towards the lower layer; and a surface layer provided above the image layer, the surface layer having an upper surface provided with concavities and convexities different for each region, the surface layer transmitting part of incident light towards the image layer.

The lower layer may include an inclination that, when a direction of light that irradiates the printed matter and an observation direction in which the printed matter is observed are known in advance, causes a reflection direction of specular reflection of the light that irradiates the printed matter to substantially match the observation direction more for a region desired to appear more glossy. Here, some examples of a direction of light that irradiates the printed matter and an observation direction of an observer are shown below. In a first example, when observing a high-class painting printed matter, the printed matter is exhibited high up or along a side wall of a room. The height of the printed matter will be substantially the same as the height of the eyes of an observer, and concretely about 1.3 to 1.8 m when the observer is in a standing position. The observation direction of the observer will be substantially a normal direction of the printed matter to be observed. It is assumed to be illuminated by a spot light hang from the ceiling or a wall of a room. Normally, the printed matter is illuminated at about 45 degrees through 70 degrees in the plane including the vertical direction and the normal direction of the printed matter, and this range of angles is set as a representative value of the illumination direction. The printed matter can also be illuminated from a slightly lateral direction of the printed matter and above the plane including the vertical direction and the normal direction of the printed matter. In a second example, the printed matter is observed on a desk in an office environment. A representative illumination environment thereof is found in FIG. 22 of Page 54, Satoshi KUBOTA, "Bionomics of Liquid Displays," The Institute for Science of Labour Publishing Department. When a printed matter on a desk is to be observed, the assumed observation direction is a normal direction of the printed matter, and the illumination direction is defined by an orientation of a fluorescent lamp positioned on the entire surface of the ceiling which is 1.6 m above the printed matter. For example, the illumination direction is assumed to be in 17 to 90 degrees above the printed matter, and its widening in the lateral direction is assumed to be ±45 degrees. In reality, the illumination direction can be determined based on the fluorescent lamps able to illuminate the printed matter according to the office environment.

In the lower layer, when a direction of light that irradiates the printed matter and an observation direction in which the printed matter is observed are known in advance, a ratio of micro regions that have an inclination that causes a reflection direction of specular reflection to substantially match the observation direction may be larger for a region desired to appear more glossy.

The surface layer may include an inclination that, when a direction of light that irradiates the printed matter and an observation direction in which the printed matter is observed are known in advance, causes a reflection direction of specular reflection of the light that irradiates the printed matter to substantially match the observation direction more for a region desired to appear more glossy.

In the surface layer, when a direction of light that irradiates the printed matter and an observation direction in which the printed matter is observed are known in advance, a ratio of micro regions that have an inclination that causes a reflection direction of specular reflection to match the observation direction may be larger for a region desired to appear more glossy.

A plurality of the regions along a lateral direction of the lower layer have respective upper surfaces provided with concavities and convexities different from each other.

A plurality of the regions along a lateral direction of the surface layer have respective upper surfaces provided with concavities and convexities different from each other.

So as to solve the stated problems, according to a second aspect of the innovations herein, provided is a printed matter forming apparatus including: a lower layer forming section that forms a lower layer having an upper surface provided with concavities and convexities different for each region; an image layer forming section that forms an image layer by printing an image above the lower layer; and a surface layer forming section that forms, above the image layer, a surface layer having an upper surface provided with concavities and convexities different for each region.

The lower layer forming section may form an inclination for each region based on a direction of specular reflection predetermined for the region.

When an incident direction of light that irradiates the printed matter and an observation direction in which the printed matter is observed are known in advance, the lower layer forming section may form an inclination for each region according to a level of gloss predetermined for the region.

According to a level of gloss predetermined for each region, the lower layer forming section may form inclinations for a plurality of micro regions included in the region.

The surface layer forming section may form an inclination for each region based on a direction of specular reflection predetermined for the region.

When an incident direction of light that irradiates the printed matter and an observation direction in which the printed matter is observed are known in advance, the surface layer forming section may form an inclination for each region according to a level of gloss predetermined for the region.

According to a level of gloss predetermined for each region, the surface layer forming section may form inclinations for a plurality of micro regions included in the region.

So as to solve the stated problems, according to a third aspect of the innovations herein, provided is a computer readable medium storing therein a program, the program causing a computer to function as a lower layer forming section that forms a lower layer having an upper surface provided with concavities and convexities different for each region; an image layer forming section that forms an image layer by printing an image above the lower layer; and a surface layer forming section that forms, on an upper surface of the image layer, a surface layer having an upper surface provided with concavities and convexities different for each region.

So as to solve the stated problems, according to a fourth aspect of the innovations herein, provided is a printed matter forming method including: forming a lower layer having an upper surface provided with concavities and convexities different for each region; forming an image layer by printing an image above the lower layer; and forming, on an upper surface of the image layer, a surface layer provided with concavities and convexities different for each region.

The summary of the invention does not necessarily describe all necessary features of the present invention. The present invention may also be a sub-combination of the features described above.

DESCRIPTION OF EXEMPLARY EMBODIMENTS

The invention will now be described based on the preferred embodiments, which do not intend to limit the scope of the present invention, but exemplify the invention. All of the features and the combinations thereof described in the embodiment are not necessarily essential to the invention.

Figure 1:
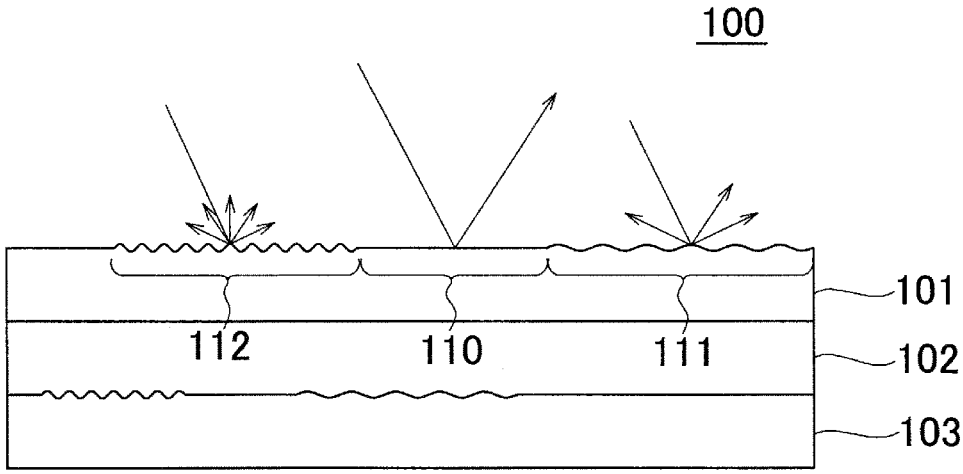
FIG. 1 shows an example of a printed matter 100 and light reflected from a surface layer 101 according to the present embodiment.
Figure 2:
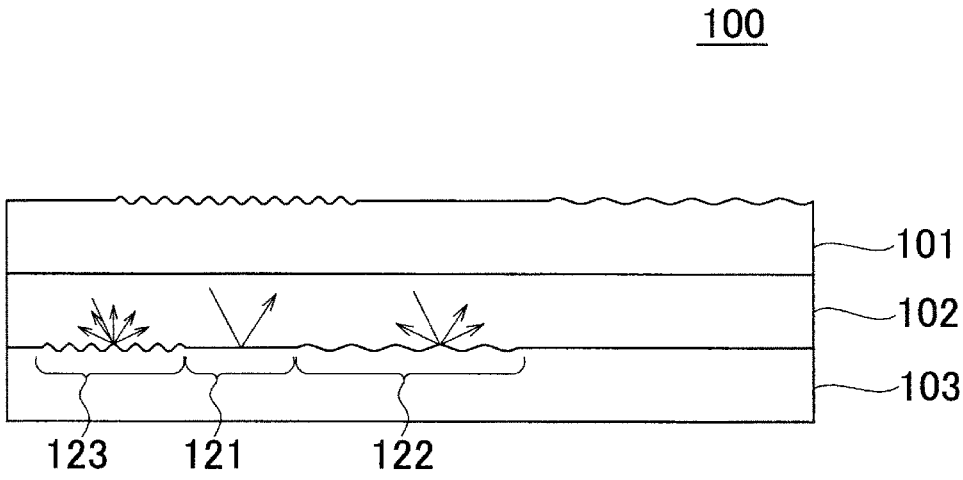
FIG. 2 shows an example of a printed matter 100 and light reflected from a lower layer 103 according to the present embodiment.

FIG. 1 and FIG. 2 show an example of a printed matter 100 according to the present embodiment. The printed matter 100 includes a surface layer 101, an image layer 102, and a lower layer 103. The lower layer 103 functions as a background on which an image is printed. The material of the lower layer 103 may be paper. The material of the lower layer 103 may also be wood, or plastic. In sum, the lower layer 103 may be made of anything as long as an image can be printed thereon. An upper surface of the lower layer 103 has concavities and convexities corresponding to respective portions of an image to be printed. Diffusible ink may be applied on the upper surface of the lower layer 103. The concavities and convexities of the lower layer 103 may be formed by concavities and convexities of the background and the diffusible ink.

The image layer 102 is formed above the lower layer, to form an image. In other words, the image printed on the lower layer 103 will be an image layer. The image layer 102 is a layer formed by ink such as pigment and paint resulting when printing the image on the lower layer 103. The ink may be a colored ink that is either transparent or semitransparent. The image layer 102 transmits part of light incident thereto towards the lower layer 103. The surface layer 101 is provided on the image layer 102. The surface layer 101 adjusts the gloss on the surface. The surface layer 101 should preferably be made of a material that is clear and colorless, such as a transparent toner and transparent ink. The surface layer 101 transmits part of light incident thereto towards the image layer 102. The surface layer 101 has concavities and convexities corresponding to respective portions of an image to be printed.

FIG. 1 shows light reflected from the surface layer 101 according to the present embodiment. The surface layer 101 includes, on an upper surface, concavities and convexities corresponding to respective portions of an image to be formed by the image layer 102. The concavities and convexities of the surface layer 101 will constitute surface roughness of the surface layer 101. That is, as the level of concavity/convexity gets large, the surface will become rough. In FIG. 1, the surface layer 101 includes a region 110 without or substantially without concavities and convexities, and a region 111 and a region 112 that include concavities and convexities. The region 111 has a smaller level of concavity/convexity, than the level of concavity/convexity of the region 112. In other words, the region 111 has a surface less rough than the surface of the region 112. The region 110 has a very small level of concavity/convexity, which accordingly has a high level of gloss. In addition, the region 111 has a large level of concavity/convexity compared to the region 110, and accordingly has a low level of gloss compared to the region 110. The region 112 also has a large level of concavity/convexity compared to the region 110, and accordingly has a low level of gloss compared to the region 110. The region 112 also has a large level of concavity/convexity compared to the region 111, and accordingly has a low level of gloss compared to the region 111. As the surface gets rougher, the gloss is less expressive. Therefore, the region 110 has the largest level of gloss, the region 111 the next, and the region 112 the least. The level of gloss for the surface layer 101 depends on how wide the distribution of the concavities and convexities on the upper surface of the surface layer 101 is in the normal direction. For example, when the distribution of the concavities and convexities in the normal direction is narrow, the level of gloss becomes high; when the distribution of the concavities and convexities in the normal direction is wide, the level of gloss becomes low. The region 112 is assumed to have a wider distribution of the concavities and convexities in the normal direction than the region 111. As the level of concavity/convexity gets high, the distribution of the concavities and convexities in the normal direction becomes wide. The roughness on the surface indicates how wide the distribution of the concavities and convexities is in the normal direction.

It is possible to adjust the specular reflection, the haze reflection, and diffuse reflectivity of light, by concavities and convexities on the surface layer 101. The inclination angle (i.e. surface angles) of the concavities and convexities of the surface layer 101 is adjusted to adjust the specular reflection, the haze reflection, and diffuse reflectivity of light. It is also possible to adjust the surface angles by area modulation. The area modulation is a technique used for representing one pixel by a collection of smaller dots, by representing the mixture ratio by the area ratio of the ink dots of different colors from each other. Macroscopically, the pixel appears as if the ink is mixed in the mixture ratio. The surface layer 101 may undergo the surface angular adjustment according to each color of ink.

Here, the level of concavity/convexity in each region of the surface layer 101 is determined according to the contents of the image formed on the image layer 102. The level of concavity/convexity on the upper surface of the surface layer 101 may be formed according to the level in which the subject in each region is desired to be glossed in the surface layer 101. For example, if Region A in the image of the image layer 102 is desired to appear glossy on the surface layer 101, the region of the surface layer 101 corresponding to Region A, i.e. the region of the surface layer 101 on Region A, is set to have a small level of concavity/convexity. On the other hand, if Region B in the image of the image layer 102 is desired to appear less glossy on the surface layer 101, the region of the surface layer 101 on Region B is set to have a level of concavity/convexity larger than the level of concavity/convexity of Region A. In this way, according to the level of gloss desired to be obtained by the surface layer 101 for each region of the image formed by the image layer 102, the level of concavity/convexity is determined for each region of the surface layer 101. The surface layer 101 may be provided with concavities and convexities different for each region of subject on the image layer 102. The boundary between a concavity and a convexity is determined according to the image formed by the image layer 102. The boundary between a concavity and a convexity may be a boundary between subjects.

The level of concavity/convexity in respective regions on the surface layer 101 may be determined according to the level of gloss that a user has designated for each region, or may be determined according to the level of gloss automatically determined based on the image data of the image formed by the image layer 102. Each region of the surface layer 101 may be determined according to a predetermined level of gloss. The automatic determination of the level of gloss may be performed by analyzing image data to determine the level of gloss on the surface layer 101 for each type of subjects. It is also possible to automatically determine the level of gloss using a table in which levels of gloss are recorded for respective types of subjects. The level of gloss may also be determined by estimating the distortion in the luminance histogram, as described in "Japanese Psychological Review" Vol. 51, No. 2, pages 235-249. The level of gloss may also be determined according to the size of the light source image on the subject, or the intensity of the light source image. A user may designate the level of concavity/convexity for each region of the surface layer 101. The surface layer 101 reflects the incident light, and therefore the color of the incident light is reflected back as it is. For example, light from a fluorescent lamp is incident, the reflected light will be white light. The upper surface of the surface layer 101 may be provided with convexities and concavities in the first direction. In this case the upper surface of the surface layer 101 may not be provided with convexities and concavities in the second direction. The first direction may correspond to a lateral direction of the image formed by the image layer 102. The second direction may correspond to a longitudinal direction of the image formed by the image layer 102. That is, the upper surface of the surface layer 101 may have different convexities and concavities along the lateral direction of the image. A man has a tendency of moving the eyes more in the lateral direction than in the longitudinal direction in viewing the image printed on the printed matters. Therefore, by differing the convexities and concavities in the lateral direction of an image, when a person moves his eyes in the lateral direction, the level of gloss on the surface layer 101 appears to change.

FIG. 2 shows light reflected from a lower layer 103 according to the present embodiment. The lower layer 103 includes, on an upper surface, concavities and convexities corresponding to respective portions of an image to be formed by the image layer 102. The concavities and convexities of the lower layer 103 will constitute surface roughness of the lower layer 103. That is, as the level of concavity/convexity gets large, the surface will become rough. The lower layer 103 includes a region 121 without or substantially without concavities and convexities, and a region 122 and a region 123 that include concavities and convexities. The region 122 has a smaller level of concavity/convexity, than the level of concavity/convexity of the region 123. In other words, the region 122 has a surface less rough than the surface of the region 123. The region 121 has a very small level of concavity/convexity, which accordingly has a high level of gloss. In addition, the region 122 has a large level of concavity/convexity compared to the region 121, which accordingly has a low level of gloss compared to the region 121. The region 123 also has a large level of concavity/convexity compared to the region 121, and accordingly has a low level of gloss compared to the region 121. The region 123 also has a large level of concavity/convexity compared to the region 122, and accordingly has a low level of gloss compared to the region 122. As the surface gets rougher, the gloss is less expressive. Therefore, the region 121 has the largest level of gloss, the region 122 the next, and the region 123 the least. The level of gloss for the lower layer 103 depends on how wide the distribution of the concavities and convexities on the upper surface of the lower layer 103 is in the normal direction. For example, when the distribution of the concavities and convexities is narrow in the normal direction, the level of gloss becomes high; when the distribution of the concavities and convexities in the normal direction is wide, the level of gloss becomes low. The region 123 is assumed to have a wider distribution of the concavities and convexities in the normal direction than the region 122. As the level of concavity/convexity gets high, the distribution of the concavities and convexities in the normal direction becomes wide. The roughness on the surface indicates how wide the distribution of the concavities and convexities is in the normal direction.

Here, the lower layer 103 is under the surface layer 101 and the image layer 102, and so the light transmitted through the surface layer 101 and the image layer 102 will be incident onto the lower layer 103. Therefore, light having the color of the image of the image layer 102 will be incident on the lower layer 103.

It is possible to adjust the specular reflection, the haze reflection, and diffuse reflectivity of light, by concavities and convexities on the lower layer 103. The inclination angle (i.e. surface angles) of the concavities and convexities of the lower layer 103 is used to adjust the specular reflection, the haze reflection, and diffuse reflectivity of light. It is also possible to adjust the surface angles by area modulation. The lower layer 103 may undergo the surface angular adjustment according to each color of ink.

Here, the level of concavity/convexity in each region of the lower layer 103 is determined according to the contents of the image formed on the image layer 102. The level of concavity/convexity on the upper surface of the lower layer 103 may be formed according to the level in which the subject in each region is desired to be glossed in the lower layer 103. For example, if Region C in the image of the image layer 102 is desired to appear glossy on the lower layer 103, the region of the lower layer 103 corresponding to Region C, i.e. the region of the lower layer 103 under Region C, is set to have a small level of concavity/convexity. On the other hand, if Region D in the image of the image layer 102 is desired to appear less glossy on the lower layer 103, the region of the lower layer 103 under Region D is set to have a level of concavity/convexity larger than the level of concavity/convexity for Region C. In this way, according to the level of gloss desired to be obtained by the lower layer 103 for each region of the image formed by the image layer 102, the level of concavity/convexity is determined for each region of the lower layer 103. The lower layer 103 may be provided with concavities and convexities different for each region of subject of the image formed on the image layer 102. The boundary between a concavity and a convexity is determined by an image. The boundary between a concavity and a convexity may be a boundary between subjects.

The level of concavity/convexity in respective regions on the lower layer 103 may be determined according to the level of gloss that a user has designated for each region, or may be determined according to the level of gloss automatically determined based on the image data of the image formed by the image layer 102. Each region of the lower layer 103 may be determined according to a predetermined level of gloss. The automatic determination of the level of gloss may be performed by analyzing image data to determine the level of gloss on the lower layer 103 for each type of subjects. For example, a high level of gloss may be set for a glossy subject. It is also possible to automatically determine the level of gloss using a table in which levels of gloss are recorded for respective types of subjects. The level of gloss may also be determined by estimating the distortion in the luminance histogram, as described in "Japanese Psychological Review" Vol. 51, No. 2, pages 235-249. The level of gloss may also be determined according to the size of the light source image on the subject, or the intensity of the light source image. A user may designate the level of concavity/convexity for each region of the lower layer 103. The lower layer 103 irradiates the light transmitted through the image layer 102, and therefore the light having the color of the image layer 102 is reflected. The upper surface of the lower layer 103 may be provided with convexities and concavities in the first direction. In this case the upper surface of the lower layer 103 may not be provided with convexities and concavities in the second direction. The first direction may correspond to a lateral direction of the image formed by the image layer 102. The second direction may correspond to a longitudinal direction of the image formed by the image layer 102.

In this way, by providing concavities and convexities in respective regions of the surface layer 101 and the lower layer 103, the expression of the texture can improve, i.e. the texture can be more fully expressed. For example, the surface layer 101 can change the level of gloss according to the level of concavity/convexity, allowing the level of gloss to change for each region. For example, as shown in FIG. 1, the region 110 of the surface layer 101 having a smallest level of concavity/convexity can express a glittering texture. Here, the light incident on the surface layer 101 is larger than the light incident to the image layer 102 or the lower layer 103, the region having a small level of concavity/convexity on the surface layer 101 can express the texture of gloss more. However, the light reflected from the upper surface of the surface layer 101 has the same color as the color of the incident light, and so the gloss does not have the same color of the image. For example, when the incident light is light of a fluorescent lamp, the reflected light will be white, which causes a glittering region to appear white even when the color of the image of the glittering region is colored (e.g. red). In this way, the gloss of the color of an image cannot be expressed by the surface layer 101. On the other hand, the light incident on the lower layer 103 has the color of the image, which can express the gloss in the color of the image by changing the level of concavity/convexity on the upper surface of the lower layer 103. For example, as shown in FIG. 2, the region 121 having the smallest level of concavity/convexity has the largest level of gloss, and so can express the gloss in the color of the image. The region 123 having the largest level of concavity/convexity expresses a small level of gloss in the color of the image. Note that the region 123 is assumed to have a large widening in the normal direction of the concavities and convexities compared to the region 122. Accordingly, by combining the level of concavity/convexity of the surface layer 101 and the level of concavity/convexity of the lower layer 103 corresponding to a region of the image layer 102, various textures can be expressed.

Figure 3:
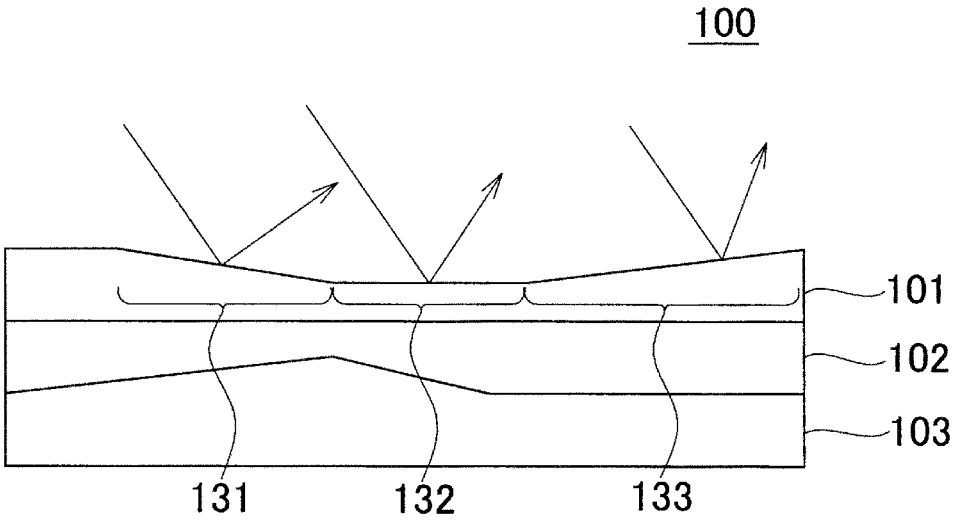
FIG. 3 shows an example of light reflected from the surface layer 101 when the surface layer 101 and the lower layer 103 are provided with inclinations.

FIG. 3 shows an example of light reflected from the surface layer 101 when the surface layer 101 and the lower layer 103 have inclinations. The surface layer 101 includes, on an upper surface, inclinations corresponding to respective portions of an image to be formed by the image layer 102. In FIG. 3, the surface layer 101 has a region 131 having a downward inclination, a region 132 without any inclination, and a region 133 having an upward inclination. Since the region 131 corresponds to a downward inclination, when the light is irradiated from the upper left, the direction of the specular reflection of light incident on the region 131 is lower than the direction of the specular reflection of light incident on the region 132. Since the region 133 corresponds to an upward inclination, when the light is irradiated from the upper left, the direction of the specular reflection of light incident on the region 133 is higher than the direction of the specular reflection of light incident on the region 132. The specular reflection refers to light reflected from a surface at a reflection angle that is the same as the incident angle of the light. The direction of specular reflection refers to the direction in which the light of specular reflection travels. In this way, by providing the surface layer 101 with inclinations, the direction of specular reflection from the surface layer 101 can be changed. Accordingly, the direction of the gloss can be changed for each region. Note that the specularly reflected light from the surface layer 101 will have a color that is the same as the color of the incident light. A plurality of regions of the surface layer 101 may have different inclinations from each other along the lateral direction. The inclinations corresponding to respective regions of the surface layer 101 are determined according to the contents of the image formed by the image layer 102. In addition, the inclinations of the surface layer 101 may be determined according to subject regions of the image formed by the image layer 102 respectively. Moreover, a user may designate the inclinations corresponding to respective regions of the surface layer 101. The boundary between inclinations may be a boundary between subjects. The inclinations of the surface layer 101 are provided so that each region undergoes a specular reflection in a predetermined direction.

Figure 4:
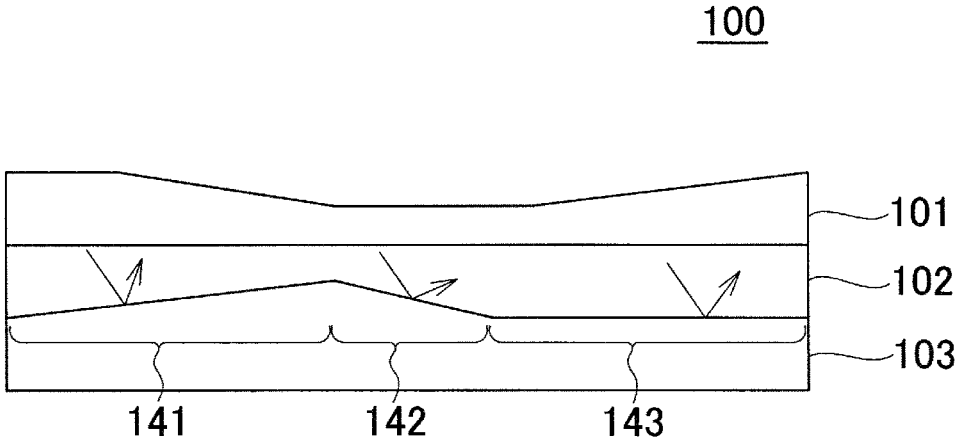
FIG. 4 shows an example of light reflected from the lower layer 103 when the surface layer 101 and the lower layer 103 are provided with inclinations.

FIG. 4 shows an example of light reflected from the lower layer 103 when the surface layer 101 and the lower layer 103 have inclinations. The lower layer 103 has, on an upper layer, inclinations different for respective regions of the image formed by the image layer 102. In FIG. 4, the lower layer 103 has a region 141 having an upward inclination, a region 142 having a downward inclination, and a region 143 without any inclination. Since the region 141 corresponds to an upward inclination, when the light is irradiated from the upper left, the direction of the specular reflection incident on the region 141 is higher than the direction of the specular reflection of light incident on the region 143. Since the region 142 corresponds to a downward inclination, when the light is irradiated from the upper left, the direction of the specular reflection of light incident on the region 142 is lower than the direction of the specular reflection of light incident on the region 143. In this way, by providing the lower layer 103 with inclinations, the direction of specular reflection from the lower layer 103 can be changed. Accordingly, the bright direction can be changed for each region. Note that the specularly reflected light from the lower layer 103 has been transmitted through the image layer 102, and so has a color corresponding to the image layer 102. The inclinations provided for respective regions of the lower layer 103 are determined according to the contents of the image formed by the image layer 102. In addition, the inclinations of the lower layer 103 may be determined according to subject regions of the image formed by the image layer 102 respectively. Moreover, a user may designate the inclinations corresponding to respective regions of the lower layer 103. The boundary between inclinations may be a boundary between subjects. The inclinations of the lower layer 103 are provided so that each region undergoes a specular reflection in a predetermined direction.

In FIG. 3 and FIG. 4, inclinations are provided for the surface layer 101 and the lower layer 103. Alternatively, in addition to providing inclinations, the inclinations may be set to have different surface roughness from each other. In other words, the embodiments explained in FIG. 3 and FIG. 4 may be combined with the embodiment explained in FIG. 1 and FIG. 2. Moreover, a plurality of regions along the lateral direction of the lower layer 103 may have different inclinations from each other.

Figure 5:
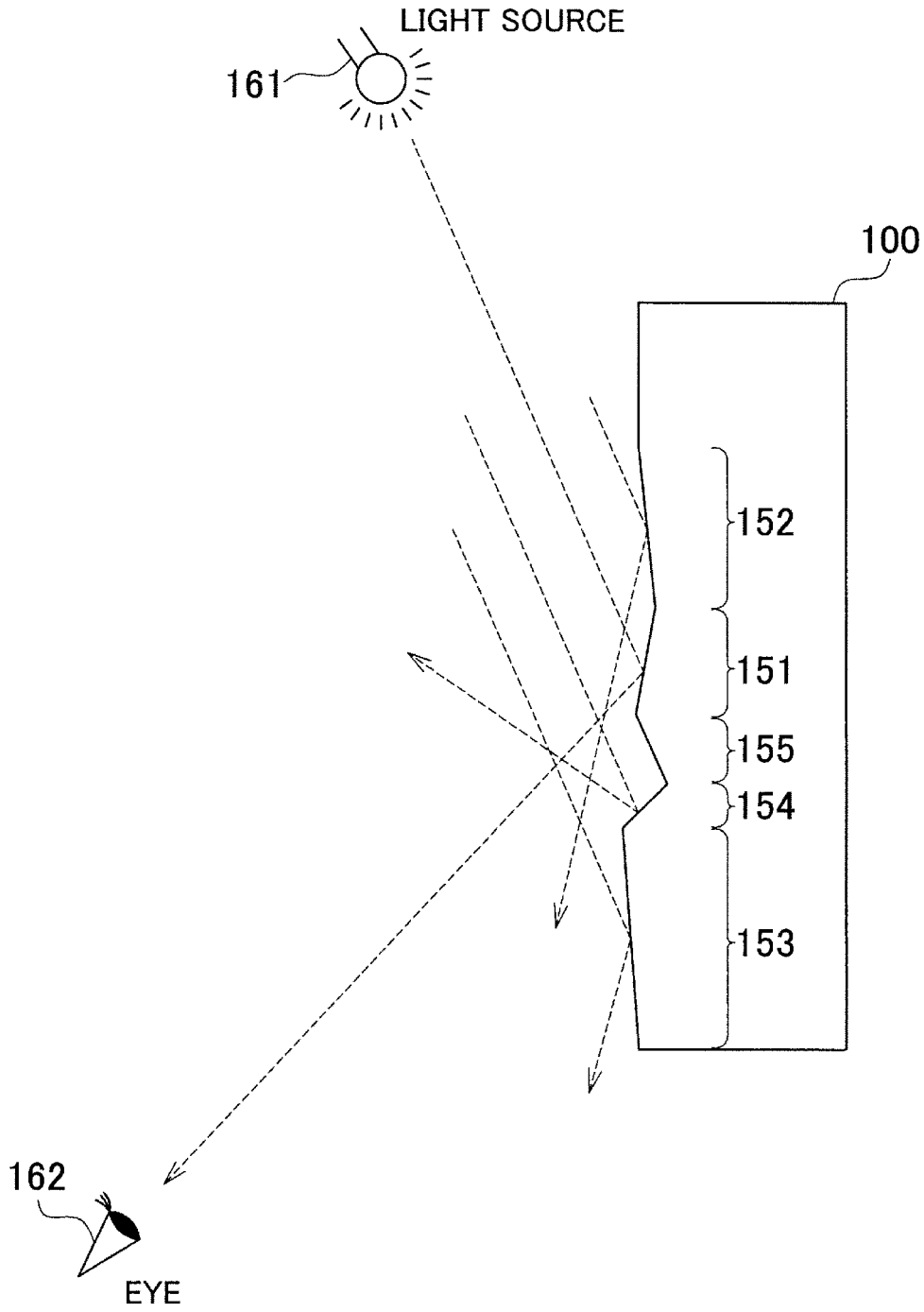
FIG. 5 shows an example of using a printed matter 100 as an advertising display or a billboard.

FIG. 5 shows an example of using a printed matter 100 as an advertising display or a billboard. When the printed matter 100 is used as an advertising display or the like, the direction in which the light is incident on each region of the printed matter 100 irradiated with the light source 161 and the direction in which the eyes 162 of an observer see each region of the advertising display can be known in advance, by using the position in which the printed matter 100 is set, the position of the light source 161 irradiating the printed matter 100, and the position of the observer of the printed matter 100. The angle of inclination for each region of the surface layer 101 of the printed matter 100 is determined based on the direction in which the light is incident on the set printed matter 100 and the observation direction. When the light incident direction and the observation direction are known in advance, the inclination for each portion of the image formed by the image layer 102 may be determined according to the contents of the image, or concavities and convexities may be set for each subject region. When the light incident direction and the observation direction are known in advance, the inclination angle of the surface layer 101 may be determined according to the level of gloss for each portion of the image formed by the image layer 102, or concavities and convexities may be set for each portion of the image.

For example, for a region desired to obtain the largest gloss effect, the inclination angle may be provided for this region so that the specular reflection direction, from the region, of light emitted from the light source 161 corresponds to a direction of the eyes 162 from the region, i.e., the observation direction. Moreover, for a region desired to obtain a medium level of glossy effect, the inclination angle may be provided for this region so that the specular reflection direction, from the region, of light emitted from the light source 161 deviates from the observation direction. When the angle formed between the specular reflection direction and the observation direction is 0 degree, the specular reflection direction matches the observation direction. When the angle formed between the specular reflection direction and the observation direction is larger than 0 degree, the specular reflection direction is different from the observation direction. As the difference between the specular reflection direction and the direction of the eyes 162 becomes large, i.e., when the angle formed therebetween becomes large, the level of gloss will decrease. In view of this, the level of gloss can be changed by changing the inclination. The region to remain dark may be set to have an inclination angle so that the light emitted from the light source 161 be not incident on the region. The specular reflection direction is a direction in which incident light is specularly reflected from the region.

In FIG. 5, the region 151 has an inclination angle so that the specular reflection direction, from the region, of light emitted from the light source 161 corresponds to the observation direction in which the eyes 162 exist. Therefore, the region 151 exhibits the highest level of gloss texture for an observer. The region 152, the region 153, and the region 154 respectively have an inclination angle so that the specular reflection direction, from the region, of light emitted from the light source 161 does not match the observation direction in which the eyes 162 exist. Therefore, the region 152, the region 153, and the region 154 obtain a level of gloss texture lower than that of the region 151 for an observer. Note that, from among the region 152, the region 153, and the region 154, the region 154 in which the specular reflection direction of the light emitted from the light source 161 is most deviated from the observation direction will exhibit the lowest level of gloss for an observer. Moreover, the light emitted from the light source 161 will not be incident on the region 155, and so an observer would see the region 155 in dark texture. Although the above explanation is about the inclination of each region of the surface layer 101, the inclination may also be provided for each region of the lower layer 103. That is, in each region of the lower layer 103, for a region that is desired to have a level of gloss in the color of the image, the inclination may be provided so that the specular reflection direction, from the region, of light emitted from the light source corresponds to the observation direction. For a region desired to look in dark texture, the inclination may be provided so that the light emitted from the light source cannot be incident to the region.

In this way, when the direction in which the light from the light source is incident and the observation direction are known in advance, by providing inclinations in respective regions of the surface layer 101 and the lower layer 103, the texture can be more fully expressed. For example, in the surface layer 101, the inclination is provided to cause the specular reflection direction of irradiated light to match more the observation direction for a region desired to appear glossier, which enables to express various levels of gloss. In addition, in the lower layer 103, the inclination is provided to cause the specular reflection direction of irradiated light to match more the observation direction for a region desired to appear glossier, and so the image can be expressed glossy in the color of the image. In addition to providing inclinations for respective regions of the surface layer 101, the inclinations may be set to have different surface roughness from each other as shown in FIG. 1. Moreover, in addition to providing inclinations for respective regions of the lower layer 103, the inclinations may be set to have different surface roughness from each other as shown in FIG. 2. Note that the concavity/convex includes an inclination, and an inclination is a subordinate concept of a concavity/convex. The surface roughness is also included in the concept of the concavity/convex.

Note that it is also possible simply to provide an inclination for a region desired to have a higher level of gloss so that the direction of the specular reflection corresponds to the observation direction and to provide the inclination for a region desired to have a lower level of gloss so that the direction of the specular reflection does not correspond to the observation direction.

For a region desired to have a higher level of gloss, the inclination is provided so that the direction of the specular reflection of light irradiated onto the region corresponds to the observation direction. However, it is also possible, for a region desired to have a higher level of gloss, to increase the ratio that the direction of the specular reflection of a plurality of micro regions included in the region matches the observation direction. In this case, the inclination is provided for each micro region. In other words, for a region desired to have a higher level of gloss, the ratio of number of micro regions having the inclination such that the direction of specular reflection matches the observation direction may be set large. For example, when the level of gloss is divided into level 0 to level 10, for a region desired to have a gloss level of 10, the inclination may be provided for all the micro regions in the region so that the direction of specular reflection of all the micro regions matches the observation region. For a region desired to have a gloss level of 5, the inclination may be provided for half of all the micro regions in the region so that the direction of specular reflection of half of all the micro regions matches the observation direction. For a region desired to have a gloss level of 1, the inclination may be provided for 1/10 of all the micro regions in the region so that the direction of specular reflection of 1/10 of all the micro regions matches the observation direction. In this way, depending on the level of gloss set for the region, the inclination of respective micro regions in the region can be changed, instead of changing the inclination of the entire region. A micro region is a small region regarded as a same normal component. As the size of a micro region gets smaller, a finer texture of gloss can be obtained. When the size of a micro region gets larger, a rougher texture of gloss can be obtained. The finer texture of gloss is generally preferable. However, it is occasionally preferable to express with a rough texture of gloss.

Figure 6:
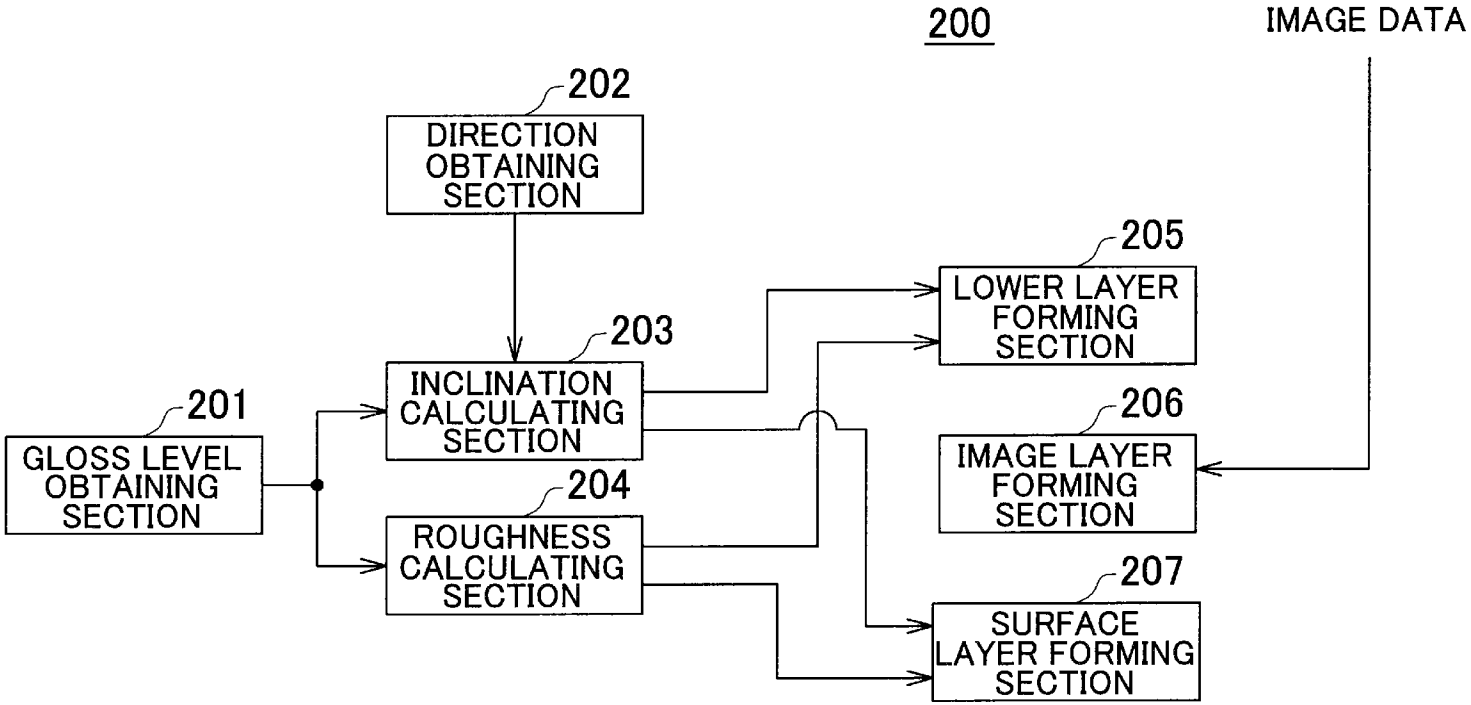
FIG. 6 shows an example of a printed matter forming apparatus 200 for forming a printed matter 100 according to the present embodiment.

FIG. 6 shows an example of a printed matter forming apparatus 200 for forming a printed matter 100 according to the present embodiment. The printed matter forming apparatus 200 includes a gloss level obtaining section 201, a direction obtaining section 202, an inclination calculating section 203, a roughness calculating section 204, a lower layer forming section 205, an image layer forming section 206, and a surface layer forming section 207.

The gloss level obtaining section 201 obtains the gloss level of each region of the printed matter 100. The gloss level obtaining section 201 may obtain the level of gloss for each region of the lower layer 103 formed by the lower layer forming section 205. The gloss level obtaining section 201 may obtain the level of gloss for each region in the surface layer 101 formed by the surface layer forming section 207. Each region of the surface layer 101 and the lower layer 103 corresponds to a portion of the image formed by the image layer 102. The level of gloss may be designated by a user. A user may designate, for each portion of the printed image data, the level of gloss on the surface layer 101 and the level of gloss on the lower layer 103. The gloss level obtaining section 201 may analyze the image data to be printed, to automatically determine the level of gloss of the surface layer 101 and the level of gloss of the lower layer 103 for each portion of the image data. In addition, the level of gloss may be determined by estimating the distortion in the luminance histogram, or the level of gloss may be determined according to the size and the intensity of the light source image on the subject. The level of gloss for each portion of the image formed by the image layer 102 is determined by the contents of the image. In addition, the level of gloss may be determined for each subject region of the image formed by the image layer 102.

The gloss level obtaining section 201 may have a table in which the level of gloss of the surface layer 101 and the level of gloss of the lower layer 103 are recorded for each type of subjects. The gloss level obtaining section 201 may analyze the image data to detect the type of subject, to automatically determine, according to the detected type, the level of gloss for the surface layer 101 and the level of gloss for the lower layer 103 for the portion of the detected type of subject, using the table. For example, when there are 10 levels of gloss, and when the subject is a mirror, the level of gloss for the surface layer 101 is set to 10, and the level of gloss for the lower layer 103 is set to 0. When the subject is a television, the level of gloss for the surface layer 101 is set to 5, and the level of gloss for the lower layer 103 is set to 5. When the subject is a shirts, the level of gloss for the surface layer 101 is set to 0, and the level of gloss for the lower layer 103 is set to 5. The gloss level 10 represents the largest gloss, and the gloss level 0 represents the least gloss. The gloss level obtaining section 201 outputs the obtained level of gloss for each region of the printed matter 100 to the inclination calculating section 203 and the roughness calculating section 204. The gloss level obtaining section 201 may output the obtained level of gloss for each region of the surface layer 101 to the inclination calculating section 203 and the roughness calculating section 204. The gloss level obtaining section 201 may output the obtained level of gloss for each region of the lower layer 103 to the inclination calculating section 203 and the roughness calculating section 204.

The direction obtaining section 202 obtains the incident direction of the light of the light source 161 seen from the printed matter 100 and the observation direction. The incident direction of the light of the light source 161 and the observation direction may be designated by a user. A table may be provided in which the place where the advertising display is set is associated with the incident direction of the light of the light source 161 and the observation direction, and a user may designate the place to set the printed matter 100, to obtain, from the table, the incident direction of the light of the light source 161 and the observation direction. The direction obtaining section 202 outputs the incident direction of the light of the light source 161 and the observation direction having been obtained, to the inclination calculating section 203. The direction obtaining section 202 may obtain the incident direction of the light of the light source 161 and the observation direction for each region of the printed matter 100.

The inclination calculating section 203 calculates the inclination angle of each region, from the gloss level of each region of the surface layer 101 transmitted from the gloss level obtaining section 201 and the incident direction of the light of the light source 161 and the observation direction transmitted from the direction obtaining section 202. That is, the inclination angle is calculated so that, when light is incident from the direction of the light source 161, the direction of specular reflection in each region becomes a predetermined direction corresponding to the level of gloss in the region. Here, the angle formed between the direction of specular reflection and the observation direction becomes larger when the level of gloss becomes smaller. This is because an observer feels less gloss when the angle formed between the direction of specular reflection and the observation direction becomes large. The inclination calculating section 203 may calculate the inclination angle at which light from the light source 161 will not be incident, for a region for expressing darkness. For example, for a region for expressing darkness, the inclination angle may be calculated so that a surface of the region becomes parallel to the incident direction of the light of the light source 161. A region for expressing darkness may be a region whose level of gloss is equal to or smaller than a threshold value. The inclination calculating section 203 may output, to the surface layer forming section 207, each calculated inclination angle of regions of the surface layer 101. The inclination calculating section 203 may output, to the surface layer forming section 207, the inclination provided for each region of the surface layer 101 designated by a user. Note that the inclination calculating section 203 may calculate the inclination angle of a plurality of micro regions included in each region, from the level of gloss of each region of the surface layer 101 and the incident direction of the light of the light source 161 and the observation direction transmitted from the direction obtaining section 202.

The inclination calculating section 203 calculates the inclination angle of each region, from the gloss level of each region of the lower layer 103 transmitted from the gloss level obtaining section 201 and the incident direction of the light of the light source 161 and the observation direction transmitted from the direction obtaining section 202. The inclination angle is calculated so that, when light is incident from the direction of the light source 161, the direction of specular reflection in each region becomes a predetermined direction corresponding to the level of gloss in the region. The inclination calculating section 203 may calculate the inclination angle at which light from the light source 161 will not be incident, for a region for expressing darkness. The inclination calculating section 203 outputs, to the lower layer forming section 205, each calculated inclination angle of regions of the lower layer 103. In addition, the inclination calculating section 203 may output, to the lower layer forming section 205, the inclination provided for each region of the lower layer 103 designated by a user. Note that the inclination calculating section 203 may calculate the inclination angle of a plurality of micro regions included in each region, from the level of gloss of each region of the lower layer 103 and the incident direction of the light of the light source 161 and the observation direction transmitted from the direction obtaining section 202.

The roughness calculating section 204 calculates the surface roughness of each region of the surface layer 101, from the level of gloss of each region of the surface layer 101 transmitted from the gloss level obtaining section 201. The roughness calculating section 204 may include a table in which the surface roughness in association with each level of gloss of the surface layer 101 is recorded in advance, to calculate the surface roughness corresponding to the level of gloss from the table. The roughness calculating section 204 outputs, to the surface layer forming section 207, each calculated surface roughness of the surface layer 101. The roughness calculating section 204 calculates the surface roughness of each region of the lower layer 103, from the level of gloss of each region of the lower layer 103 transmitted from the gloss level obtaining section 201. Alternatively, the roughness calculating section 204 may include a table in which the surface roughness in association with each level of gloss of the lower layer 103 is recorded in advance, to calculate the surface roughness corresponding to the level of gloss from the table. The roughness calculating section 204 outputs, to the lower layer forming section 205, each calculated surface roughness of regions of the lower layer 103. The roughness calculating section 204 may output, to the surface layer forming section 207, the roughness provided for each region of the surface layer 101 designated by a user. In addition, the roughness calculating section 204 may output, to the lower layer forming section 205, the roughness provided for each region of the lower layer 103 designated by a user.

The lower layer forming section 205 forms the lower layer 103 in which each region of the upper surface is provided with concavities and convexities. When the roughness calculating section 204 has calculated surface roughness, the lower layer forming section 205 forms the lower layer 103 in which each region is provided with concavities and convexities, according to the surface roughness of each region of the lower layer 103. When the inclination calculating section 203 has calculated an inclination angle, the lower layer forming section 205 forms the lower layer 103 by providing concavities and convexities (i.e., by providing inclinations) on each upper surface of the lower layer 103 for each region according to the inclination angle of each region of the lower layer 103. For example, when there are 10 levels of gloss, a region with the gloss level 10 is provided with an inclination so that the direction of specular reflection corresponds to the observation direction. In addition, a region with the gloss level 5 may be provided with an inclination so that the angle formed between the direction of the specular reflection and the observation direction is 45 degrees. When there are 10 levels of gloss, for a region with the gloss level 10, the inclination may be provided so that the direction of specular reflection in all the micro regions of the region matches the observation direction. For a region with the gloss level 5, the inclination may be provided so that the direction of specular reflection in half of the micro regions of the region matches the observation direction. In other words, for a region having a higher level of gloss, the ratio that the direction of specular reflection of the plurality of micro regions of the region matches the observation direction may be set larger.

When the inclination calculating section 203 and the roughness calculating section 204 have calculated the inclination angle and the surface roughness respectively, the lower layer forming section 205 forms the lower layer 103 by providing concavities and convexities for each region, based on the inclination angle and the surface roughness of each region. The lower layer forming section 205 may cut out the upper surface of paper such as print paper, to form the lower layer by providing concavities and convexities for each region. The lower layer may also be formed by cutting out the upper surface of wood in a planer form. The lower layer forming section 205 may form the lower layer by providing concavities and convexities for each region by spraying ink on paper such as print paper. The lower layer forming section 205 may form the concavities and convexities by foaming the foam ink after attaching the foam ink on paper such as print paper. The lower layer forming section 205 may form surface roughness by applying diffusible ink. The lower layer forming section 205 may perform surface angular adjustment by area modulation. The lower layer forming section 205 may form the lower layer 103 solely according to the roughness calculated by the roughness calculating section 204, or may form the lower layer 103 solely according to the inclination angle calculated by the inclination calculating section 203.

The image layer forming section 206 obtains image data to be printed. The image layer forming section 206 forms the image layer 102 on the lower layer 103, by printing the image of the obtained image data, on the lower layer 103 formed by the lower layer forming section 205. The image layer forming section 206 may perform color/concentration adjustment by area modulation. The image layer forming section 206 may perform printing in a ink jet method, a dot impact method, a xerographic method, or the like. The image layer forming section 206 may include a printing appliance such as a laser printer and an ink jet printer. An information processing apparatus such as a CPU having read a program may cause a printing appliance to function as the image layer forming section 206.

The surface layer forming section 207 forms the surface layer 101 provided with concavities and convexities different for each region, on the image layer 102. The surface layer forming section 207 forms the surface layer 101 provided with concavities and convexities for each region, according to the surface roughness of each region of the surface layer 101 transmitted from the roughness calculating section 204. According to the inclination angle of each region of the surface layer 101 transmitted from the inclination calculating section 203, the surface layer forming section 207 forms the surface layer 101 by providing concavities and convexities (i.e. by providing inclinations) on each upper surface of the surface layer 101 for each inclination. For example, when there are 10 levels of gloss, a region with the gloss level 10 is provided with an inclination so that the direction of specular reflection corresponds to the observation direction. In addition, a region with the gloss level 5 may be provided with an inclination so that the angle formed between the direction of the specular reflection and the observation direction is 45 degrees. When there are 10 levels of gloss, for a region with the gloss level 10, the inclination may be provided so that the direction of specular reflection in all the micro regions of the region matches the observation direction. For a region with the gloss level 5, the inclination may be provided so that the direction of specular reflection in half of the micro regions of the region matches the observation direction. In other words, for a region having a higher level of gloss, the ratio that the direction of specular reflection of the plurality of micro regions of the region matches the observation direction may be set larger.

The surface layer forming section 207 forms the surface layer 101 by providing concavities and convexities for each region, based on the inclination angle and the roughness of each region transmitted from the inclination calculating section 203 and the roughness calculating section 204. The surface layer forming section 207 may also form the surface layer by attaching a glossy film on the image layer 102 and cutting out the upper surface of the glossy film, to provide concavities and convexities for each region. The surface layer forming section 207 may form the lower layer by providing concavities and convexities for each region by spraying glossy ink or transparent ink. The surface layer forming section 207 may form the surface layer 101 solely according to the roughness calculated by the roughness calculating section 204, or may form the surface layer 101 solely according to the inclination angle calculated by the inclination calculating section 203. The lower layer forming section 205, the image layer forming section 206, and the surface layer forming section 207 form the printed matter 100 shown in FIG. 1 through FIG. 5. Note that the lower layer forming section 205 and the surface layer forming section 207 may provide the lower layer 103 and the surface layer 101 with a predetermined geometric pattern such as canvas and Japanese paper, respectively, to express the texture more fully.

The gloss level obtaining section 201, the direction obtaining section 202, the inclination calculating section 203, the roughness calculating section 204, the lower layer forming section 205, the image layer forming section 206, and the surface layer forming section 207 may be realized using an information processing apparatus such as a computer, or by an electronic circuit. The printed matter forming apparatus 200 may be realized by an information processing apparatus having read a predetermined program. The printed matter forming apparatus may be equipped with a recording medium for recording a predetermined program.

Although some aspects of the present invention have been described by way of exemplary embodiments, it should be understood that those skilled in the art might make many changes and substitutions without departing from the spirit and the scope of the present invention which is defined only by the appended claims.

The operations, the processes, the steps, or the like in the apparatus, the system, the program, and the method described in the claims, the specification, and the drawings are not necessarily performed in the described order. The operations, the processes, the steps, or the like can be performed in an arbitrary order, unless the output of the former-described processing is used in the later processing. Even when expressions such as "First," or "Next," or the like are used to explain the operational flow in the claims, the specification, or the drawings, they are intended to facilitate the understanding of the invention, and are never intended to show that the described order is mandatory.

What is claimed is:

1. A printed matter forming method comprising:

determining, for a position in which the printed matter is to be set, a direction of incident light and a direction of an observer;

forming a lower layer having an upper surface provided as a plurality of flat surfaces provided at different angles of inclination;

forming an image layer by printing an image above the lower layer; and forming, above the image layer, a surface layer provided as a plurality of flat surfaces provided at different angles of inclination;

wherein in at least one of the upper surface and the surface layer, the plurality of flat surfaces are set according to the determined direction of incident light and the determined direction of the observer.

2. The printed matter forming method according to claim 1, wherein the plurality of flat surfaces are set differently in different portions of the image.

3. The printed matter forming method according to claim 1, wherein the plurality of flat surfaces are set according to the contents of the image.

4. The printed matter forming method according to claim 1, wherein the plurality of flat surfaces are set according to a predetermined level of gloss.

5. The printed matter forming method according to claim 1, wherein the plurality of flat surfaces are set according to a predetermined direction of specular reflection.

6. The printed matter forming method according to claim 1, wherein in both the upper surface and the surface layer, the plurality of flat surfaces are set according to the determined direction of incident light and the determined direction of the observer.

* * * * *